United States Patent [19]

Nee et al.

[11] Patent Number: 4,869,971

[45] Date of Patent: Sep. 26, 1989

[54] MULTILAYER PULSED-CURRENT ELECTRODEPOSITION PROCESS

[76] Inventors: Chin-Cheng Nee, 27 Doris Rd., Framingham, Mass. 01701; Rolf Weil, 47 Carteret St., West Orange, N.J. 07052

[21] Appl. No.: 298,820

[22] Filed: Jan. 23, 1989

Related U.S. Application Data

[63] Continuation of Ser. No. 866,434, May 22, 1986, abandoned.

[51] Int. Cl.[4] ..... C25D 5/10; C25D 5/18

[52] U.S. Cl. ..... 428/635; 204/40; 204/44; 204/44.5; 428/637; 428/675; 428/678; 428/935

[58] Field of Search ..... 204/14.1, 40, 41, 43.1, 204/44, 44.2, 44.5; 428/610, 635, 636, 637, 658, 663, 664, 675, 678

[56] References Cited

U.S. PATENT DOCUMENTS

| | | | |
|---|---|---|---|
| 2,726,203 | 12/1955 | Rockafellow | 204/50 |
| 3,383,303 | 5/1968 | Fenoglio et al. | 204/228 |
| 3,480,522 | 11/1969 | Brownlow | 204/40 |
| 3,616,434 | 10/1971 | Hausner | 204/228 |
| 3,756,788 | 9/1973 | Whetstone | 428/675 X |
| 3,886,053 | 5/1975 | Leland | 204/36 |
| 3,959,088 | 5/1976 | Sullivan | 204/14 R |
| 4,048,043 | 9/1977 | Bick et al. | 204/204 R |
| 4,082,622 | 4/1978 | Gebauer | 204/40 |
| 4,120,759 | 10/1978 | Asami et al. | 204/14 R |
| 4,240,881 | 12/1980 | Stanya | 204/28 |
| 4,549,940 | 10/1985 | Karwan | 204/13 |

FOREIGN PATENT DOCUMENTS

| | | | |
|---|---|---|---|
| 56-98493 | 8/1981 | Japan . | |
| 1433850 | 4/1976 | United Kingdom | 204/40 |

OTHER PUBLICATIONS

John A. Mock, On-Off Plating Puts Down Dense, Fine-Grained Finished, ME, Sept. 1978, pp. 76–78.

Richard Haynes, Quantity of Metal Deposited in Pulsed Plating vs. Direct Current Plating, *Journal of the Electrochemical Society,* May, 1979. p. 881.

C. J. Raub et al. Pulse-Plated Gold, *Plating and Surface Finishing,* Sep. 1978, pp. 32–34.

U. Cohen et al., Electroplating of Cyclic Multilayered Alloy (CMA) Coatings, *Journal of the Electrochemical Society,* Oct. 1983, pp. 1987–1995.

Dennis Tench et al., Enhanced Tensile Strength for Electrodeposited Nickel-Copper Multilayer Composites, *Metallurgical Transactions A,* vol. is 15A, Nov. 1984, pp. 2039–2040.

Max Hansen, Constitution of Binary Alloys, McGraw-Hill Book Company Inc., New York, 1958, pp. 648–655.

(List continued on next page.)

*Primary Examiner*—John F. Niebling
*Assistant Examiner*—William T. Leader
*Attorney, Agent, or Firm*—Pennie & Edmonds

[57] ABSTRACT

A process for electrodepositing a multilayer deposit on an electrically-conductive substrate from a single electrodeposition bath yields a deposit which includes a sequence of essentially repeating groups of layers. Each group of layers comprises a layer of a first electrodeposited material and a layer of a second electrodeposited layer. The process includes the steps of immersing the substrate in an electrodeposition bath and repeatedly passing a charge burst of a first electric current and a second electric current through the electrodeposition bath to the substrate. The first electric current is a pulsed current with a first pulsed-on/off waveform and a first peak current density which is effective to electrodeposit the first electrodeposited material. The second electric current has a second waveform and a second current density which is effective to electrodeposit the second electrodeposited material. The duration of the charge bursts of the first and second electric currents is effective to cause layers of the first and second electrodeposited material of desired thicknesses to be deposited. Electrodeposits produced by preferred process of the invention can have outstanding mechanical and other properties.

18 Claims, 3 Drawing Sheets

OTHER PUBLICATIONS

Debasis Baral et al., Historical Survey of Artific ally Prepared Composition Modulated Structures, fron Ph. D. Thesis entitled "On the Mechanical and The no-electric Behavior of Composition Modulated Fc ls", Northwestern University, Jun. 1983.

Abner Brenner, *Electrodeposition of Alloys,* Acad nic Press, New York, 1963; vol. I, pp. 447, 461, 63, 472–475; vol. II, pp. 415–416.

C. Nee and R. Weil, "The Banded Structure of N i–P Electrodeposits", Surface Technology, 25 (1985) pp. 7–15.

U. Cohen., K. Walton and R. Sand, "Development of Ag–Pd Alloy Plating for Electrical Contact Application", JEST vol. 131, [11] (1984) pp. 2489–2495.

M. Kato et al. "Hardening by Spinodal Modulated Structure," *Acta Mettallurgical,* vol. 28 (1980) pp. 285–290.

W. Yang et al. "Enhanced Elastic Modulus in Composition Modulatated Au–Ni and Cu–Pd Foils" *J. Appl. Phys., vol. 48, No. 3 (1977), pp. 876–879.*

A. Avila and M. Brown, "*Design Factors in Pulse Plating*", Plating (Nov. 1970), pp. 1106–1108.

Inside R & D (May 21, 1986) p. 1.

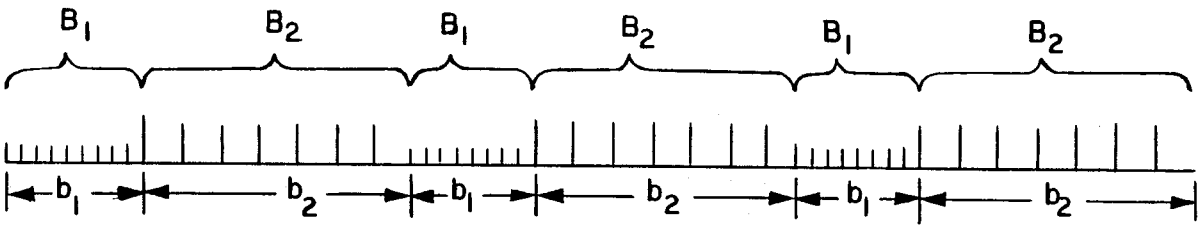
FIG. IA
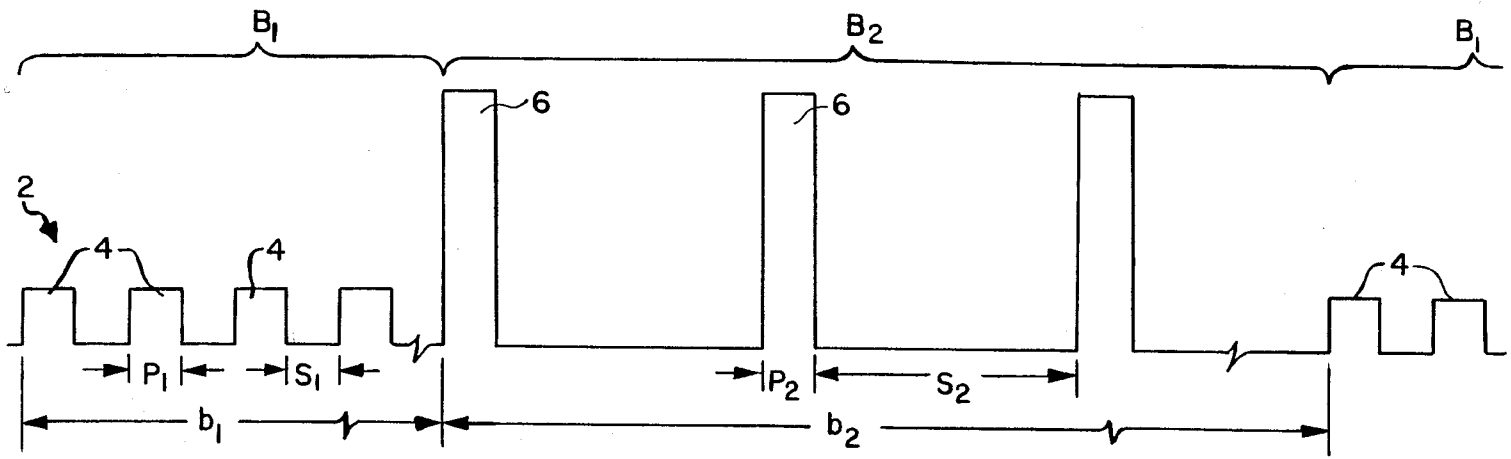
FIG. IB

MULTILAYER PULSED-CURRENT ELECTRODEPOSITION PROCESS

This is a continuation of application Ser. No. 06/866,434, filed May 22, 1986 now abandoned.

TECHNICAL FIELD

The present invention concerns a process employing a single electrodeposition bath for electrodepositing multiple layers of at least two distinct materials on a substrate.

BACKGROUND ART

Electrodeposition is one of the most widely used processes for applying metallic coatings on the surfaces of articles. Such metallic coatings are frequently applied in order to confer improved appearance, resistance to corrosion, resistance to wear, hardness, frictional properties, solderability, electrical characteristics, or other surface properties.

Electrodeposition processes entail deposition of a metal or alloy from a solution onto a surface of an article by electrochemical action driven by an electric current. Electrodeposition processes are carried out by contacting an electrically-conductive surface, termed the substrate surface, with a solution of one or more metal salts and passing an electric current through the solution to the surface. The substrate surface is thus made to form a cathode of an electrochemical cell. Metal cations from the solution are reduced at the substrate surface by electrons from the electric current so that a reduced metal or alloy deposits on the surface. The term "electrodeposition" refers both to electroplating processes, in which the deposited metal or alloy adheres to the substrate surface, and to electroforming processes, in which the deposited metal or alloy is detached from the substrate surface after it is deposited.

For an electrodeposition bath of a given composition, the microstructure, composition and other properties of the material deposited from the bath generally depend in part upon the characteristics of the electric current used in the electrodeposition process. An article by J. J. Avila and M. J. Brown in the November 1970 issue of *Plating* disclosed a pulse plating process for electroplating gold using an electric current which was rapidly pulsed on and off. In the pulse-plating process as described in the article, the current was switched on for a time sufficient to deposit the ions of gold in the electroplating bath adjacent to the cathode and was then switched off until the bath equilibrium was reestablished. According to the article, an advantage of electroplating gold with a pulsed current relative to plating with a conventional direct current stemmed from reducing concentration polarization at the cathode, which tended to eliminate hydrogen gas bubbles at the cathode. Hydrogen embrittlement was reduced and the gold deposit had a relatively high density and purity. The gold electroplated with the pulsed current was essentially homogeneous in structure and composition.

U.S. Pat. No. 3,886,053 (the '053 patent) disclosed a hone-forming process for electroplating chromium which involved simultaneously plating and machining the surface to be plated. The plating current was pulsed to control the hardness of the chromium. Specifically, the "on-time" period and "off-time" period of the pulsed plating current were initially selected to form soft, bonding plating at the junction of the chromium plating and the surface to be plated. Thereafter, the off-time period of the pulsed plating current was progressively reduced to increase the hardness of the plated chromium. The progressive reduction of the off-time continued until the off-time was reduced to zero near the end of the process, so that a maximum hardness was obtained at the wearing surface. According to the '053 patent, the gradual increase in hardness across the thickness of the plating avoided hydrogen embrittlement of the base metal and reduced tensile-stress adhesion failures of the plating.

An article by U. Cohen et al. in *Journal of the Electrochemical Society,* volume 130, pp. 1987–1995, disclosed a process for producing multilayered deposits of silver-palladium alloy for electrical contacts. The layers of the deposits were arranged in a cyclic sequence. Differences in thickness and composition between the individual layers were obtained by modulating the current to the cathode during electrodeposition. The authors reported that, other than a difference in brightness, a preliminary comparison between the cyclic multilayered silver-palladium alloy and silver-palladium alloys plated with a conventional direct current did not reveal any clear differences in tests relevant to the contact finish properties of the alloys.

DISCLOSURE OF THE INVENTION

We have invented a process for electrodepositing a multilayer deposit from a single electrodeposition bath which permits characteristics of the deposit to be beneficially controlled and permits certain multilayer deposits with uniquely advantageous properties to be produced.

The multilayer deposit prepared by the process of the invention comprises a sequence of essentially repeating groups of layers. Each group of layers includes a layer of a first electrodeposited material and a layer of a second electrodeposited material. The first and second electrodeposited materials are distinct materials with respect to one another.

The process of the invention includes the step of immersing an electrically-conductive substrate in an electrodeposition bath.

The process further includes the step of passing a charge burst of a first pulsed electric current through the electrodeposition bath to the substrate. The first pulsed electric current has a first pulsed-on/off waveform and a first peak current density effective to electrodeposit the first electrodeposited material. The duration of the charge burst of the first pulsed electric current is effective to cause a layer of the first electrodeposited material of a desired thickness to be deposited.

The process further includes the step of passing a charge burst of a second electric current through the electrodeposition bath to the substrate. The second electric current has a second waveform and a second current density effective to electrodeposit the second electrodeposited material. The second waveform may be a pulsed-on/off waveform, a constant-value waveform, or other waveform. The duration of the charge burst of the second pulsed electric current is effective to cause a layer of the second electrodeposited material of a desired thickness to be deposited.

The preceding two steps are repeated a plurality of times in the process of the invention to deposit the sequence of essentially repeating groups of layers. Each group includes a layer of the first electrodeposited material deposited by a charge burst of the first pulsed electric current and a layer of the second electrodeposited material deposited by a charge burst of the second electric current.

It is ordinarily preferred for each group of layers to consist of two layers of distinct materials, although repeating groups of three or more layers may be deposited if desired. The layers within a given group may be distinct from one another in terms of chemical composition, crystal structure, crystal grain size, morphology, or other property.

For example, a preferred process of the invention can be used to deposit alternate layers of alpha brass and beta brass from a single plating solution to obtain a material which has a structure which is analogous to the structure of a lamellar eutectic material.

In another preferred process of the invention, a multilayered deposit of beta brass is produced from a single plating solution, the deposit having alternate layers of beta brass in an ordered crystal configuration and in a disordered crystal configuration. Beta brass in a disordered crystal configuration cannot ordinarily be produced at room temperature by processes other than electrodeposition processes. However, with conventional electrodeposition processes, beta brass with disordered and ordered crystal configurations cannot be produced from a single electrodeposition bath.

In yet another preferred process of the invention, a multilayer deposit of brass is produced from a single plating solution in which the deposit has alternate layers of brass in a single phase with differing proportions of copper. The structure of such a single-phase multilayer deposit is analogous to a spinodal structure.

In another preferred process of the invention a multilayer deposit of a nickel-molybdenum alloy is produced from a single plating solution in which the deposit is made up of pairs of adjacent layers, one layer of each pair having a crystal grain size which is substantially smaller than the crystal grain size of the other layer.

A sample of metal or alloy of a given thickness made up of multiple layers deposited according to the process of the invention can have significantly improved mechanical properties relative to a corresponding sample electrodeposited in a substantially unitary layer of the same thickness by only one of the electric-current waveforms used to make the multiple-layer sample. For example, foils of brass alloy made up of a sequence of repeating pairs of alternate layers deposited according to a preferred process of the invention tended to exhibit a greater fracture strength on average than either of two types of corresponding reference foils of the alloy, each of which reference foil was electrodeposited using a pulsed electric current employed for depositing one of the alternate layers of the multilayered foil. Moreover, the multilayered brass foil exhibited a true strain at fracture—a measure of ductility—which was more than 6.5 times the true strain at fracture of either of the two reference foils. Increased ductility as exhibited by the preferred multilayered brass foil of the invention facilitates forming such foils mechanically into complex shapes relative to conventional electrodeposited brass foils of the same thickness.

BRIEF DESCRIPTION OF THE DRAWINGS

Preferred embodiments of the invention are described below with reference to the following drawings:

FIG. 1A is a schematic timing diagram of a train of three pairs of charge bursts of electrodeposition current for a preferred process of the invention;

FIG. 1B is a schematic timing diagram of a portion of the train of charge bursts of FIG. 1A on an expanded time scale.

BEST MODE FOR CARRYING OUT THE INVENTION

The process of the present invention can be carried out using a conventional electroplating cell equipped with a programmable low voltage, high-current power supply for a current source. The programmable power supply is preferably capable of producing essentially constant currents of a selectably programmable intensity and pulsed-on/off currents made up of current pulses of selectably programmable peak intensity. The widths of the current pulses; that is, the duration of time the current is switched on to produce a single pulse, is preferably selectably programmable from a pulse width of several seconds down to 1 millisecond or less. The spacing of the current pulses; that is, the duration of time the current is switched off between adjacent pulses, is preferably programmable from a pulse spacing of several seconds down to 1 millisecond or less.

A preferred pulse train 2 for the process of the invention is shown in FIGS. 1A and 1B. The horizontal axis in FIGS. 1A and 1B corresponds to time in arbitrary units and the vertical axis corresponds to current density in arbitrary units. The pulse train of FIG. 1A consists of a repeating sequence of pairs of charge bursts of current pulses. The charge bursts of each pair are designated $B_1$ and $B_2$ in FIG. 1A. Although three pairs of charge bursts of pulsed current are shown in FIG. 1A, the number of pairs is a matter of choice. As shown best in FIG. 1B, the first charge burst of pulses consists of a series of current pulses 4 of width $p_1$ separated by a pulse spacing $s_1$. The pulses 4 are applied for a charge-burst time $b_1$. The second charge burst $B_2$ consists of a series of current pulses 6 of width $p_2$ separated by a pulse spacing $s_2$. The pulses 6 of the charge burst $B_2$ are applied for a charge-burst time $b_2$. The pair of charge bursts $B_1$ and $B_2$ are repeated in turn a desired number of times to deposit a corresponding number of pairs of layers of material. The widths of the current pulses $p_1$ and $p_2$ preferably varies in the range of from about 1 msec to about 100 msec. The spacings $s_1$ and $s_2$ between the pulses preferably varies in the range of from about 1 msec to about 50 msec. The peak intensity of the current in each pulse is a factor in determining the properties of the material deposited in the charge burst. Preferably the peak pulse current density varies in the range of from about 2.5 $mA/cm^2$ to about 100 $mA/cm^2$, referring to the exposed surface area on which the material is to be deposited.

Figure 2:
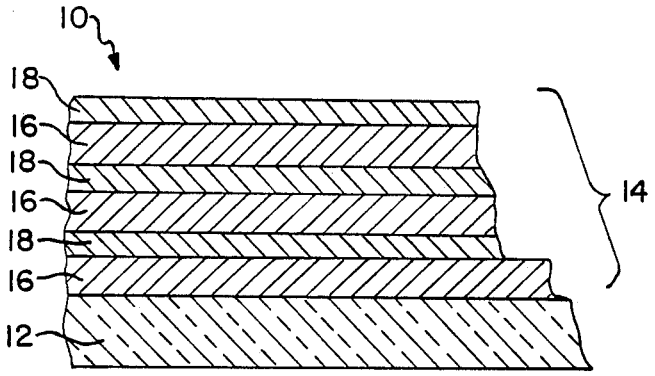
FIG. 2 is a schematic cross-sectional view of a six-layer deposit produced according to the process of FIGS. 1A and 1B.

Turning now to FIG. 2, a sample 10 of electrodeposited material produced according to the process of FIGS. 1A and 1B is shown schematically in cross section. The sample 10 consists of a substrate 12 upon which is plated a six-layer deposit 14 of electrodeposited material. The substrate 12 is made of an electrically-conductive material. The six-layer deposit 14 consists of three layers of a first material 16 interleaved with three layers of a second material 18. The six layers of the deposit 14 are deposited in turn by the six charge bursts of pulsed plating current illustrated in FIG. 1A. The layers 16 of the first material are deposited by the three charge bursts $B_1$ of the first pulsed current. The three layers 18 of the second material are deposited by the three charge bursts $B_2$ of the second pulsed current. The thickness of each layer 16, 18 is determined by the time duration of the corresponding charge bursts. The first material of layers 16 differs from the second material of layers 18 because the peak pulse current and pulse spacing of the pulses of charge burst $B_1$ differ from the peak pulse current and pulse spacing of the pulses of charge burst $B_2$.

The process of the present invention may be used to advantage with conventional electrodeposition solutions. The process of the invention can be used to particular advantage in plating brass alloys from a plating solution containing copper and zinc ions. When a pulsed plating current is used with a copper-zinc plating solution, the properties of the electrodeposited brass alloy depend upon the pulse width, the pulse spacing and the peak pulse current of the current pulses, as illustrated by the graph of FIG. 3 discussed below.

Figure 3:
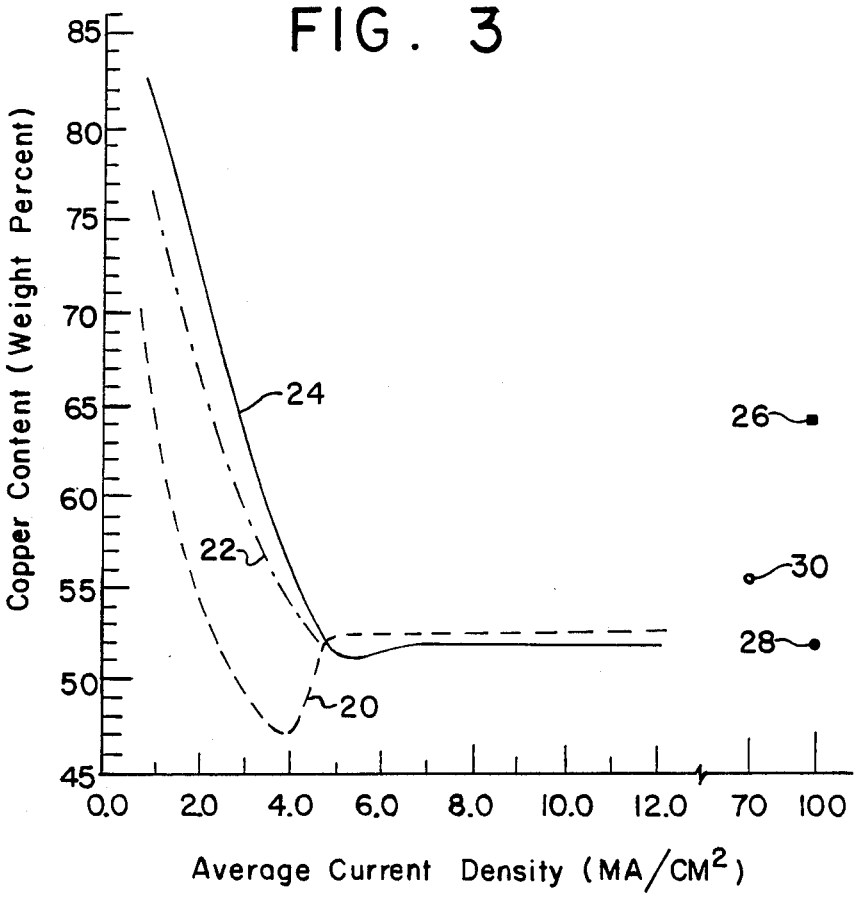
FIG. 3 is a graph of the weight percent copper content of an electrodeposited brass alloy versus average current density for electrodeposition currents of a number of different waveforms.

The graph of FIG. 3 illustrates the variation in composition of electrodeposited brass alloys for a number of pulsed currents using the copper-zinc plating solution specified in Example I below. Specifically, the graph of FIG. 3 shows the variation in copper content of the brass alloy as a function of the average current density of the plating current. The lines and points of the graph of FIG. 3 correspond to the current parameters set forth in the following Table I:

TABLE I

| Line/Point | Waveform | Pulse Width (msec) | Pulse Spacing (msec) |
|---|---|---|---|
| 20 ---- | direct current | — | — |
| 22 ---- | pulsed on/off | 100 | 50 |
| 24 — | pulsed on/off | 1 | 1 |
| 26 ■ | pulsed on/off | 1 | 1 |
| 28 ● | pulsed on/off | 1 | 5 |
| 30 ○ | pulsed on/off | 1 | 5. |

EXAMPLES

In the following Examples, a substrate of either polycrystalline zinc or polycrystalline copper was used, prepared as set forth below.

A sheet of polycrystalline zinc was prepared as follows. A thin zinc sheet of about 40 micrometers thick was obtained by rolling a zinc plate which had an initial thickness of about 2 mm. The sheet was cut to a rectangular shape about 50 mm long and about 45 mm wide. The zinc sheet was then annealed for about 10 minutes in boiling water to produce a relatively randomly-oriented polycrystalline structure.

The annealed zinc sheet was then degreased in trichloroethane to remove surface contamination and then dipped in an approximately two-percent hydrochloric acid solution until a substantially uniform layer of hydrogen bubbles formed on the surface. One side of the zinc sheet was then completely coated with a dilute polymeric insulating lacquer such that a thin and essentially uniform coating was obtained. The opposite side of the sheet was similarily coated with the lacquer except for a centrally located substantially circular area approximately 40 mm in diameter. After the lacquer coating was nearly dry, a second coat was similarily applied to the same areas and allowed to dry partially. Additional coats of lacquer were similarily applied to the same areas until a lacquer coating effective to insulate the coated areas was built up. The lacquer was then allowed to dry in air at ambient temperature for about 24 hours.

The uncoated circular area of the zinc sheet was then electropolished for about 20 minutes at approximately 2.4 V in a solution containing about 50 percent orthophosphoric acid and about 50 percent ethanol at room temperature. Essentially pure nickel having a larger surface area than the zinc substrate served as the cathode for the electropolishing step.

The electropolished zinc sheet was then rinsed for about 1 minute in ethanol containing about 10 percent orthophosphoric acid and then rinsed in essentially neat ethanol for about 30 seconds. The sheet was then rinsed in triple-distilled water twice to remove any residual acid and transferred immediately to the plating solution. Special care was taken to avoid surface dewetting during the entire preparation process.

A sheet of polycrystalline copper was prepared as follows. A thin copper sheet of about 75 micrometers thick was cut. from a foil of polycrystalline copper to a rectangular shape about 50 mm long and about 45 mm wide.

The copper sheet was then degreased in trichloroethane to remove surface contamination and then dipped in an approximately twenty-percent nitric acid solution until a substantially uniform layer of bubbles formed on the surface. One side of the copper sheet was then coated with the dilute polymeric insulating lacquer such that a thin and essentially uniform coating was obtained. Except for a centrally-located substantially circular area about 40 mm in diameter, the opposite side of the sheet was similarily coated with the lacquer. After the lacquer coating was nearly dry, a second coat was similarily applied to the same areas and allowed to dry partially. Additional coats of lacquer were similarly applied to the same areas until a lacquer coating effective to insulate the coated areas was built up. The lacquer was then allowed to dry in air at ambient temperature for about 24 hours.

The uncoated circular area of the copper sheet was then electropolished for about 10 minutes at approximately 1.7 V in a solution containing approximately 67-percent orthophosphoric acid at room temperature. Essentially pure nickel having a larger surface area than the copper substrate served as the cathode for the electropolishing step.

The electropolished copper sheet was then rinsed for about 1 minute in approximately fifteen-percent orthophosphoric acid to remove insoluble phosphates. The sheet was then rinsed in triple-distilled water for about ten seconds and then immersed in an approximately five percent solution of sodium hydroxide for about fifteen seconds. The sheet was then again rinsed in triple-distilled water for about ten seconds and then immersed in an approximately ten-percent solution of sulfuric acid for about twenty seconds. The copper sheet was then twice rinsed in triple-distilled water and transferred immediately to the plating solution. Special care was taken to avoid surface dewetting during the preparation process.

EXAMPLE I

A solution containing copper and zinc ions for plating brass was prepared. The copper-zinc plating solution was prepared by dissolving the following compounds of a chemically-pure grade in distilled water approximately in the amounts indicated in the following Table II:

TABLE II

| Compound | Grams Per Liter of Solution |
|---|---|
| cuprous cyanide | 32 |
| zinc cyanide | 55 |
| sodium cyanide | 95 |
| sodium carbonate | 20 |
| ammonium hydroxide | 20. |

The pH of the resulting solution was adjusted to a value of about 10.2 by adding sodium bicarbonate.

The copper-zinc plating solution was placed in the plating tank of an electroplating cell. The plating tank had a capacity of roughly 1 liter. The temperature of the plating solution in the plating tank was maintained at approximately 37° C. The plating solution was stirred with a magnetic stirrer.

A sheet of about 70 weight-percent copper/30-weight-percent zinc brass was immersed in the plating solution in the tank to serve as an anode. The brass anode was rectangular in shape about 50 mm long and about 45 mm wide. A sheet of polycrystalline zinc coated with an insulating lacquer except for a circular area on one side about 40 mm in diameter prepared as described above was then immersed in the plating solution to serve as the cathode of the electrochemical cell. The uncoated circular area on the zinc sheet served as the substrate for the electrodeposition.

Current for the electroplating cell was provided by a computer programmable power supply commercially available from EG&G Princeton Applied Research of Princeton, N.J. under the trade name Model 173 Potentiostat/Galvanostat with a Model 276 interface. The power supply was digitally programmed by an Apple IIc computer commercially available from Apple Computer, Inc. of Cupertino, California. The zinc substrate cathode of the electroplating cell was connected to the negative voltage output of the programmable power supply. The brass anode was connected to the positive voltage output of the power supply.

For Example I, the power supply was programmed to produce a repeating sequence of pairs of charge bursts of pulsed current. A first charge burst in each pair of charge bursts was about 240 seconds long and the second charge burst in each pair was about 38 seconds long. The current during the first charge burst had an essentially square waveform with pulse width of about 1 msec and a pulse spacing of about 1 msec. The pulses of the first charge burst had a peak current density of about 7 mA/cm$^2$. The pulsed current during the first charge burst will be referred to below as a low-current-density beta (LCDB) pulsed current. During the second charge burst, the current had a rectangular waveform with a pulse width of about 1 msec and a pulse spacing of about 5 msec. The pulses of the second charge burst had a peak current density of approximately 100 mA/cm$^2$. The pulsed current during the second charge burst will be referred to below as a high-current-density beta (HCDB) pulsed current.

The first charge burst of pulsed current of each pair of charge bursts produced a layer of brass of a beta structure referred to below as LCDB beta brass. Each layer of LCDB beta brass was approximately 0.5 micrometers thick. The second charge burst of each pair of charge bursts produced a layer of beta brass referred to below as HCBD beta brass. Each layer of HCDB beta brass was approximately 0.25 micrometers thick. The repeating sequence of pairs of alternate charge bursts was maintained until a multilayered-deposit approximately 10 micrometers thick was obtained.

The LCDB beta brass and the HCDB beta brass were different from one another. Evidence of superlattice dislocations in the structure of the LCDB beta brass as shown in transmission electron micrographs and by extra spots in electron diffraction patterns indicated that the LCDB beta brass was in an ordered crystal configuration.

For comparison, samples of two types of foils of beta brass were deposited from the copper-zinc plating solution specified in Table II above using the same electroplating cell. Comparison foils of the first type were deposited using the low-current-density beta (LCDB) pulsed current only. Consequently, each comparison foil of the first type consisted of an essentially uniform layer of LCDB beta brass. The comparison foils of the second type were deposited using the high-current-density beta (HCDB) pulsed current. Consequently, each comparison foil of the second type consisted of an essentially uniform layer of HCDB beta brass. Samples of the multilayer foils produced according to the invention and the two comparison foils of LCDB beta brass and HCDB beta brass were removed from their respective polycrystalline zinc substrates by submerging the plated substrates in an approximately three-percent solution of hydrochloric acid to dissolve the substrates. The foils were essentially circular in shape about 40mm in diameter because of the lacquer coating of the substrate sheets. The hydrochloric acid solution did not appreciably alter the composition of the brass foils plated on the substrates. The fracture strength and true strain at fracture of the sample foils were measured using a standard bulge test. The results of the bulge tests—averaged over at least four samples in each case—are set out in the following Table III:

TABLE III

| Foil Type | Fracture Strength (MPa) | True Strain at Fracture (percent) |
|---|---|---|
| LCDB | 10.4 | 3.4 |
| HCDB | 9.3 | 3.8 |
| Alternating LCDB/HCDB | 12.0 | 25.0. |

As is evident from Table III, alternating LCDB/HCDB foils of this example tend on average to have a greater fracture strength than comparison foils of either the LCDB type or the HCDB type. Moreover, the multilayer foils are substantially more ductile than either type of comparison foil, as measured by the true strain at fracture.

Example II

The procedure of Example I employing a train of pairs of charge bursts of pulsed current was repeated with the following exceptions. The current during the first charge burst of each pair had a peak current density of about 3 mA/cm$^2$. The waveform was essentially the same as the waveform during the first charge burst of Example I; i.e., an essentially square waveform with a pulse width of about 1 msec and pulse spacing of about 1 msec. The pulsed current during the first charge burst of Example II will be referred to below as a low-current-density alpha (LCDA) pulsed current.

The waveform of the pulsed current during the second charge burst of each pair of charge bursts was an essentially square waveform with a pulse width of about 1 msec and a pulse spacing of about 1 msec. During the second charge burst of Example II, the peak current density was about the same as the peak current density during the second charge burst of Example I; i.e., about 100 mA/cm$^2$. The pulsed current during the second charge burst of Example II will be referred to below as a high-current-density alpha (HCDA) pulsed current.

The first charge burst of LCDA pulsed current of each pair of charge bursts produced a layer of brass of an alpha structure approximately two micrometers thick. The brass deposited during the first charge burst is referred to below as LCDA alpha brass. The second charge burst of HCDA pulsed current of each pair of charge bursts produced a layer of alpha brass approximately one micrometer thick. The brass deposited during the second charge burst is referred to below as HCDA alpha brass. The repeating sequence of pairs of alternate charge bursts was maintained until a multilayered deposit roughly 10 micrometers thick was obtained. The crystal grain size of the layers of LCDA alpha brass differed from the crystal grain size of the layers of the HCDA alpha brass.

EXAMPLE III

Figure 4:
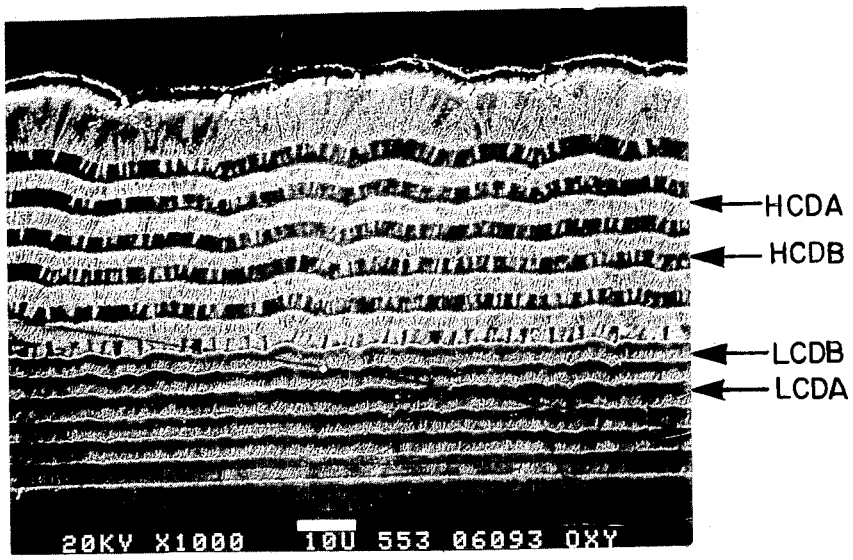
FIG. 4 is a scanning electron micrograph of a multilayered deposit of brass alloy produced according to the process of the present invention from a single plating solution.

Using the brass plating solution and electroplating cell of Example I and charge bursts of the four currents LCDA, HCDA, LCDB and HCDB defined in Examples I and II, a single sample was prepared on a copper substrate having a first repeating section of alternate layers of LCDB beta brass and LCDA alpha brass and a second repeating section of alternate layers of HCDB beta brass and HCDA alpha brass. Thus, the first sequence consisted of alternate layers of alpha and beta brass produced by a low current density pulsed current and the second sequence of repeating layers consisted of alternate layers of alpha and beta brass produced by a high-current-density pulsed current. FIG. 4 shows a scanning electron micrograph of a cross-section of the multilayered brass alloy of Example III.

EXAMPLE IV

The procedures of Examples I and II were followed to produce four electrodeposits having: (1) alternate layers of alpha and beta brass produced by the low-current-density alpha (LCDA) and low current density beta (LCDB) pulsed currents respectively; (2) alternate layers of alpha and beta brass produced by the high-current-density alpha (HCDA) and low-current-density beta (LCDB) pulsed currents respectively; (3) alternate layers of alpha and beta brass produced by the low-current-density alpha (LCDA) and high-current-density beta (HCDB) pulsed currents respectively, and (4) alternate layers of beta brass produced by the high-current-density beta (HCDB) and the low-current-density beta (LCDB) pulsed currents respectively.

EXAMPLE V

A solution for plating alloys of nickel and molybdenum was prepared. The nickel-molybdenum plating solution was prepared by dissolving the following compounds of a chemically-pure grade in distilled water approximately in the amounts indicated in the following Table IV:

TABLE IV

| Compound | Grams Per Liter Of Solution |
|---|---|
| Nickel sulfate hexahydrate | 84 |
| Sodium molybdate bihydrate | 20 |
| Sodium citrate | 105. |

The pH of the resulting solution was adjusted to a value of about 10.5 by adding ammonium hydroxide.

The nickel-molybdenum plating solution was placed in the plating tank of the electroplating cell of Example I. The temperature of the nickel-molybdenum alloy plating solution in the plating tank was maintained at approximately 60° C. and the solution was stirred with a magnetic stirrer.

A sheet of essentially pure nickel was connected to the positive voltage output of the programmable power supply and immersed in the plating solution in the tank serve as an anode. A sheet of polycrystalline copper coated with an insulating lacquer except for a circular area on one side about 40 mm in diameter was then connected to the negative voltage output of the programmable power supply and was immersed in the plating solution in the tank to serve as the cathode.

The programmable power supply of the electroplating cell was programmed to produce a repeating sequence of pairs of alternate charge bursts of current. The first charge burst of each pair of charge bursts was about 240 seconds long and the second charge burst of each pair was about 30 seconds long. The current during the first charge burst was approximately constant at a current density of about 2.5 mA/cm$^2$. Very fine grained deposits of nickel-molybdenum alloy were produced during the first charge burst of each pair of charge bursts. During the second charge burst, the current was pulsed on and off with an essentially square waveform with a pulse width of about 1 msec and a pulse spacing of about 1 msec. During the pulse the peak current density was approximately 50 mA/cm$^2$. During the second charge burst, larger grained deposits of nickel-molybdenum alloy were produced than during the first charge burst.

It was found that when plating a layer of nickel-molybdenum alloy of large grain size over a layer of the alloy with a fine grain size that transition layer about 0.5 micrometer thick was formed across which the grain size increased gradually from that of the fine grain size to that of the large grain size.

It is not intended to limit the present invention to the specific embodiments disclosed above. It is recognized that changes may be made in the products and processes specifically described herein without departing from the scope and teaching of the invention. It is intended to encompass all embodiments, alternatives, and modifications consistent with the present invention.

We claim:

1. A process for electrodeposition a multilayer deposit on an electrically conductive substrate from a single electrodeposition bath containing copper ions and zinc ions for electrodepositing brass-alloy material, the deposit comprising a sequence of essentially repeating groups of layers each group of layers comprising a layer of first electrodeposited brass-alloy material and a layer of a second electrodeposited brass-alloy material, the first electrodeposited brass-alloy material being a distinct material from the second electrodeposited brass-alloy material, the process comprising the steps of:

(a) immersing the substrate in the electrodeposition bath;

(b) passing a charge burst of a first pulsed electric current through the electrodeposition bath to the substrate, the first pulsed electric current having a first pulsed-on/off waveform and a first peak current density effective to electrodeposit the first electrodeposited brass-alloy material, the duration of the charge burst of the first pulsed electric current being effective to cause a layer of the first electrodeposited brass-alloy material of a desired thickness to be deposited;

(c) passing a charge burst of a second electric current through the electrodeposition bath to the substrate, the second electric current having a second waveform and a second current density effective to electrodeposit the second electrodeposited brass-alloy material, at least one of the second waveform and the second current density differing respectively from the first waveform and the first current density, the duration of the charge burst of the second electric current being effective to cause a layer of the second electrodeposited brass-alloy material of a desired thickness to be deposited; and (d) repeating steps (b) and (c) a plurality of times to deposit the sequence of essentially repeating groups of layers, each group comprising a layer of the first electrodeposited brass-alloy material and a layer of the second electrodeposited brass-alloy material.

2. The process according to claim 1 in which the second electric current is a pulsed electric current, the second waveform being a pulsed-on/off waveform.

3. The process according to claim 2 in which the first pulsed electric current is made up of current pulses having a pulse width in the range of from about 1 msec to about 100 msec and a pulse spacing in the range of from about 1 msec to about 50 msec; and the second pulsed electric current is made up of current pulses having a pulse width in the range of from about 1 msec to about 100 msec and a pulse spacing in the range of from about 1 msec to about 50 msec.

4. The process according to claim 3 in which the first pulsed electric current is effective to plate an alpha brass from the electrodeposition bath and the second electric current is effective to plate a beta brass from the electrodeposition bath.

5. The process according to claim 4 in which the first pulsed-on/off waveform is an essentially square waveform of about 1 msec on and about 1 msec off and the first peak current density is approximately 3 mA/cm$^2$, and the second pulsed electric current has an essentially square waveform of about 1 msec on and about 1 msec off and a peak current density of approximately 100 mA/cm$^2$.

6. The process according to claim 3 in which the first pulsed electric current is effective to plate a beta brass of a disordered crystal configuration from the electrodeposition bath and the second electric current is effective to plate a beta brass of an ordered crystal configuration from the electrodeposition bath.

7. The process according to claim 6 in which each layer of beta brass of the disordered crystal configuration is approximately 0.5 micrometer thick and each layer of beta brass of the ordered crystal configuration is about 0.25 micrometers thick.

8. The process according to claim 3 in which the first pulsed-on/off waveform is an essentially square waveform of about 1 msec on and about 1 msec off and the first peak current density is approximately 7 mA/cm$^2$, and the second waveform is an essentially rectangular waveform of about 1 msec on and about 5 msec off and the second current density is approximately 100 mA/cm$^2$.

9. The process according to claim 8 in which each layer produced by a charge burst of the first pulsed electric current is approximately 0.5 micrometers thick and each layer produced by a charge burst of a second electric current is approximately 0.25 micrometers thick.

10. A multilayer material comprising a sequence of essentially repeating groups of layers, each group of layers including a layer of an alpha brass and a layer of a beta brass, wherein the material is an electrodeposit produced by the process of claim 1.

11. A multilayer material comprising a sequence of essentially repeating groups layers, each group of layers including a layer of a beta brass in an ordered crystal configuration and a layer of a beta brass in a disordered crystal configuration, wherein the material is an electrodeposit produced by the process of claim 1.

12. A multilayer material comprising a sequence of essentially repeating groups of layers, each group of layers including a layer of an alpha brass and a layer of a beta brass.

13. A multilayer material comprising a sequence of essentially repeating groups of layers, each group of layers including a layer of a beta brass in an ordered crystal configuration and a layer of a beta brass in a disordered crystal configuration.

14. A process for electrodepositing a multilayer deposit on an electrically conductive substrate from a single electrodeposition bath containing nickel ions and molybdenum ions for plating nickel-molybdenum-alloy material, the deposit comprising a sequence of essentially repeating groups of layers, each group of layers comprising a layer of a first electrodeposited nickel-molybdenum-alloy material and a layer of a second electrodeposited nickel-molybdenum-alloy material, the first electrodeposited nickel-molybdenum-alloy material being a distinct material from the second electrodeposited nickel-molybdenum-alloy material, the process comprising the steps of:

(a) immersing the substrate in the electrodeposition bath;

(b) passing a charge burst of a first pulsed electric current through the electrodeposition bath to the substrate, the first pulsed electric current having a first pulsed-on/off waveform and a first peak current density effective to electrodeposit the first electrodeposited nickel-molybdenum-alloy material, the duration of the charge burst of the first pulsed electric current being effective to cause a layer of the first electrodeposited nickel-molybdenum-alloy material of a desired thickness to be deposited;

(c) passing a charge burst of a second electric current through the electrodeposition bath to the substrate, the second electric current having a second waveform and a second current density effective to electrodeposit the second electrodeposited nickel-molybdenum-alloy material, at least one of the second waveform and the second current density differing respectively from the first waveform and the first current density, the duration of the charge burst of the second electric current being effective to cause a layer of the second electrodeposited nickel-molybdenum-alloy material of a desired thickness to be deposited; and (d) repeating steps (b) and (c) a plurality of times to deposit the sequence of essentially repeating groups of layers, each group comprising a layer of the first electrodeposited nickel-molybdenum-alloy material and a layer of the second electrodeposited nickel-molybdenum-alloy material.

15. The process according to claim 14 in which the second electric current has an essentially constant current density.

16. The process according to claim 15 in which the layer of nickel-molybdenum alloy deposited by each charge burst of first pulsed electric current has an average crystal grain size which is greater than the average crystal grain size of the nickel-molybdenum alloy deposited by each charge burst of the second electric current.

17. A multilayer material comprising a sequence of essentially repeating groups of layers, each group of layers including a layer of a nickel-molybdenum alloy having crystal grains of first average size and a layer of a nickel-molybdenum alloy having crystal grains of a second average size different from the first average size, wherein the material is an electrodeposit produced by the process of claim 14.

18. A multilayer material comprising a sequence of essentially repeating groups of layers, each group of layers including a layer of a nickel-molybdenum alloy having crystal grains of first average size and a layer of a nickel-molybdenum alloy having crystal grains of a second average size different from the first average size.

* * * * *

UNITED STATES PATENT AND TRADEMARK OFFICE

CERTIFICATE OF CORRECTION

PATENT NO. : 4,869,971

DATED : September 26, 1989

INVENTOR(S) : Chin-Cheng Nee and Rolf Weil

It is certified that error appears in the above-identified patent and that said Letters Patent is hereby corrected as shown below:

On the title page:

The Assignee is the Trustees of The Stevens Institute of Technology.

Signed and Sealed this

Eighteenth Day of December, 1990

*Attest:*

HARRY F. MANBECK, JR.

*Attesting Officer*

*Commissioner of Patents and Trademarks*